US007234803B2

(12) United States Patent
Amma et al.

(10) Patent No.: US 7,234,803 B2
(45) Date of Patent: Jun. 26, 2007

(54) INK JET RECORDING CARTRIDGE HAVING A LID FOR PRESSING AN ABSORBER AND COMMONLY USABLE IN OTHER INK JET RECORDING CARTRIDGE CONFIGURATIONS

(75) Inventors: Hiromasa Amma, Kanagawa (JP); Wataru Takahashi, Kanagawa (JP); Masashi Ogawa, Kanagawa (JP); Yasuo Kotaki, Kanagawa (JP)

(73) Assignee: Canon Kabushiki Kaisha

( * ) Notice: Subject to any disclaimer, the term of this patent is extended or adjusted under 35 U.S.C. 154(b) by 298 days.

(21) Appl. No.: 11/014,609

(22) Filed: Dec. 16, 2004

(65) Prior Publication Data

US 2005/0140761 A1 Jun. 30, 2005

(30) Foreign Application Priority Data

Dec. 26, 2003 (JP) ..... 2003-434950

(51) Int. Cl.
*B41J 2/175* (2006.01)

(52) U.S. Cl. ..... 347/86

(58) Field of Classification Search ..... 347/86, 347/87

See application file for complete search history.

(56) References Cited

U.S. PATENT DOCUMENTS

| | | | | |
|---|---|---|---|---|
| 5,790,158 | A * | 8/1998 | Shinada et al. | 347/86 |
| 6,082,852 | A * | 7/2000 | Soga et al. | 347/86 |
| 6,161,927 | A * | 12/2000 | Long et al. | 347/86 |
| 6,250,750 | B1 * | 6/2001 | Miyazawa et al. | 347/87 |
| 7,018,028 | B2 * | 3/2006 | Chou et al. | 347/86 |
| 2004/0114001 | A1 * | 6/2004 | Hayashi et al. | 347/86 |

* cited by examiner

*Primary Examiner*—Hai Pham
*Assistant Examiner*—Carlos A. Martinez, Jr.

(57) ABSTRACT

An ink jet cartridge including a case, in which the bottom portion where an ink jet recording head is disposed projects, and a lid for covering the top surface thereof. In an ink containing chamber defined by the these case and the lid, there is provided an absorber. The lid is configured so that ribs provided directly over the projecting bottom are higher than the other ribs, and so that the lid can be used for different types of cartridge. In a black cartridge, the pertinent ribs perform the function of effectively bringing the absorber into pressure contact with an ink introducing section. In a color cartridge, the pertinent ribs perform the function of restraining the height of the top surface of the absorber disposed on the projecting bottom portion to a position lower than that of the top surface of each of the other absorbers.

6 Claims, 17 Drawing Sheets

INK JET RECORDING CARTRIDGE HAVING A LID FOR PRESSING AN ABSORBER AND COMMONLY USABLE IN OTHER INK JET RECORDING CARTRIDGE CONFIGURATIONS

BACKGROUND OF THE INVENTION

1. Field of the Invention

The present invention relates to an ink jet recording cartridge that includes an ink jet recording head for discharging liquid such as ink onto a recording medium and performing recording thereon, and a liquid containing section for holding liquid to be supplied to this ink jet recording head.

2. Description of the Related Art

As conventional ink jet recording cartridges, one having configurations shown in FIGS. 27 to 33 have been known. FIGS. 27 and 29, respectively, are a sectional view of a black cartridge 10B for a black ink (B), and a plan view thereof with a lid removed. FIGS. 28 and 30, respectively, are a sectional view of a color cartridge 10C for three colors of magenta (M), cyan (C), and yellow (Y), and a plan view thereof with a lid removed. FIGS. 31 to 33, respectively, are plan views of a lid 11B of the black cartridge 10B, an inner lid 11C-2 and an outer lid 11C-1 of the color cartridge 10C, as viewed from the sides of their joint surfaces with cases 15B and 15C.

The black cartridge 10B and the color cartridge 10C include the cases 15B and 15C, respectively, that form respective ink containing chambers, the lid 11B, and the inner and outer lids 11-C1 and 11C-2, respectively. The ink containing chambers of the black cartridge 10B and the color cartridge 10C, respectively, contain absorbers 16B, 16-Y, 16C-M and 16C-C that absorb and hold the respective inks. Ink jet recording heads 20B and 20C are mounted on the bottom surfaces of the cases 15B and 15C, respectively. The cases 15B and 15C have substantially the same external shape, and the portion where each of the ink jet recording heads 20B and 20C is disposed has a shape lowered by one step (see FIGS. 27 and 28). A T-shaped inner wall is arranged within the case 15C of the color cartridge 10C, so as to partition the case into ink containing chambers of three color inks (see FIG. 30).

In both of the black cartridge 10B and the color cartridge 10C, ink (not shown) held in the absorbers 16B, 16C-Y, 16C-M and 16C-C, respectively, pass through filters 17B, 17C-Y, 17C-M and 17C-C provided at front ends of ink introducing sections 18B, 18C-Y, 18C-M and 18C-C, respectively. The ink is then supplied to the ink jet recording heads 20B and 20C through ink flow paths 19B, 19C-Y, 19C-M and 19C-C, respectively, that are formed in the ink introducing sections 18B, 18C-Y, 18C-M and 18C-C, respectively. At this time, in order to prevent air from entering the ink flow paths 19B, 19C-Y, 19C-M and 19C-C, the absorbers 16B, 16C-Y, 16C-M and 16C-C are pressed against the filters 17B, 17C-Y, 17C-M and 17C-C, respectively, by ribs 14B and 14C formed in the lid 11 and the inner lid 11-C2 so as to be brought into pressure contact with the filters 17B, 17C-Y, 17C-M and 17C-C, respectively (see FIGS. 27 and 28).

In this conventional example, a single lid 11B is provided for the black cartridge 10B, whereas two lids, i.e., the outer lid 11C-1 and the inner lid 11C-2 are provided for the color cartridge 10C. Furthermore, the constructions of these lids are also different between the black cartridge 10B and the color cartridge 10C (see FIGS. 31 to 33).

Now that ink jet recording devices are coming down in price, ink jet recording heads to be mounted thereon also face a significant challenge of reducing cost. Usually, a plurality of ink jet recording heads are mounted on a single ink jet recording device. A method for reducing the number of components of an ink jet recording head, therefore, is effective as cost-reduction measures for the ink jet recording head. Use of such measures would allow the overall cost of ink jet recording device to be significantly reduced.

The same goes for an ink jet recording cartridge. For the ink jet recording cartridge, supposing that ink jet recording head portion is a single unit, the number of components constituting the cartridge is low. Also, as seen from the cases 15*b*, 15C, the lid 11B, and the inner lid 11C-2 in the above-described conventional example, each of these components already has a plurality of functioning sections. Therefore, for the ink jet recording cartridge, it is very difficult to reduce the component number itself. With this being the situation, it is an effective measures for the ink jet recording cartridge to achieve commonality of components among a plurality of kinds of ink jet recording cartridges, and thereby improve production efficiency to realize cost reduction.

SUMMARY OF THE INVENTION

The present invention is directed to an ink jet recording head that allows commonality of components among ink jet recording cartridges, thereby enabling achievement of further cost reduction.

In one aspect of the present invention, an ink jet recording cartridge that includes: an ink jet recording head for discharging ink; at least one absorber for holding the ink; a case having at least one ink containing chamber sized and shaped to contain the absorber therein and having an opening, wherein the case supports the ink jet recording head affixed thereto, and an ink introducing section communicating the ink containing chamber with the ink jet recording head; and a lid having a plurality of ribs. The lid is adapted to attach to the case at the opening of the ink containing chamber such that the ribs abut the absorber to press the absorber against the liquid introducing section in the case connecting with the ink jet recording head. The plurality of ribs includes first ribs having a different height than the other plurality of ribs. The lid is adapted to attach to a plurality of kinds of ink jet recording cartridges that are different from each other in the number of the ink containing chambers.

According to these features, by providing the lid with a plurality of ribs different in height, the functionality of the lid can be enhanced, but nevertheless, by providing commonality of the lid among a plurality of kinds of ink jet recording cartridges, the production efficiency can be improved.

The plurality of kinds of ink jet recording cartridges using a common lid thereamong have substantially the same external shape. Thereby, for example, each of the plurality of kinds of ink jet recording cartridges can be suitably used to be mounted as a common carriage among ink jet recording devices.

As an external shape of the ink jet recording cartridge, particularly, the portion where the ink jet recording head is provided have an external shape projecting in the direction away from the lid. Use of an ink jet recording cartridge having such an external shape allows a hold-down member for holding down the recording medium to be arranged in the vicinity of the ink jet recording head while allowing the ink jet recording head to be located in an appropriate position close to a recording medium during a recording operation, thereby achieving excellent recording quality.

The ink jet recording cartridge having such an external shape can be configured so that the height of the ribs of the lid, formed in positions opposite to the projection portion in the external shape is higher than that of the other ribs. Thereby, in the ink jet recording cartridge having a single ink containing chamber, although the opening portion of the ink introducing section is located at a portion away from the lid further than the other portion in the ink containing chamber, the absorber can be effectively brought into pressure contact with the opening portion to prevent air from entering the ink introducing section during ink supply. On the other hand, in the ink jet recording cartridge having a plurality of ink containing chambers, its bottom portion is located in a lower position. Therefore, in the ink jet recording cartridge having a plurality of ink containing chambers, the position of the top surface of the absorber disposed in the ink containing chamber that is longer in the height direction than the other ink containing chambers, is made lower than that of the top surface of each of the other absorbers, whereby the absorber with a smaller planar area is prevented from having a too large height, resulting in excellent ink supply performance.

The ink jet recording cartridge according to the present invention can use a common lid between a black cartridge having an ink containing chamber containing a black ink that is widely used, and a color cartridge having a plurality of ink containing chambers containing a respective plurality of color inks.

In order to meet high-speed recording requirement, the black cartridge may be configured to have an ink introducing section with a larger bore than those in the color cartridge. Here, forming ribs of the lid, at positions opposite to the ink introducing section of the black cartridge to be higher than the other ribs, allows the absorber to be securely brought into pressure contact with the opening of the ink introducing section by the action of a relatively strong pressing force, thereby preventing the entry of air into the ink introducing section.

On the other hand, the absorber to be contained in each of the ink containing chambers of the color cartridge may have a rectangular parallelepiped shape. Thereby, in each of the ink containing chambers, the absorber can be caused to satisfactorily abut against the opening of the ink introducing section of each of the ink containing chambers using ribs with uniform heights, so that the lid can also be used for the color cartridge without disturbing the above-described height relationship between ribs in the lid.

In the present invention, the color cartridge may be configured to have particularly three ink containing chambers containing respective three color inks widely used.

The three ink containing chambers of the color cartridge can have a configuration partitioned by a T-shaped inner wall as viewed from the side where the lid is joined to the case. Here, in the lid, when first ribs are provided in the vicinities of the center of the three ink containing chambers, second ribs are provided at positions along the periphery of each of the ink containing chambers, and the second ribs are formed to be higher than the first ribs, the absorbers can be prevented from running over from the respective ink containing chambers during the production process of the color cartridge, by the second ribs, which are provided at the positions along the periphery of each of the ink containing chambers. On the other hand, when this lid is used for the black cartridge, out of the second ribs provided at the positions along the periphery of each of the ink containing chambers, the rib located in the vicinity of the central branch portion of the T-shaped inner wall can be disposed at a position corresponding to the opening of the ink introducing section of the black cartridge. As a result, the above-described rib allow the absorber to be effectively brought into pressure contact with the opening of the ink introducing section with a relatively large bore, thereby preventing the entry of air into the ink introducing section.

According to the present invention, by using a common lid among a plurality of kinds of ink jet recording cartridge different in the number of ink containing chambers, the production efficiency can be improved, leading to a reduced production cost. As a lid, one having a plurality of ribs different in height, and hence, having higher functionality can be employed.

Further features and advantages of the present invention will become apparent from the following description of the embodiments with reference to the attached drawings.

DESCRIPTION OF THE EMBODIMENTS

Hereinafter, exemplary embodiments according to the present invention will be described with reference to the accompanying drawings.

First Embodiment

Figure 1:
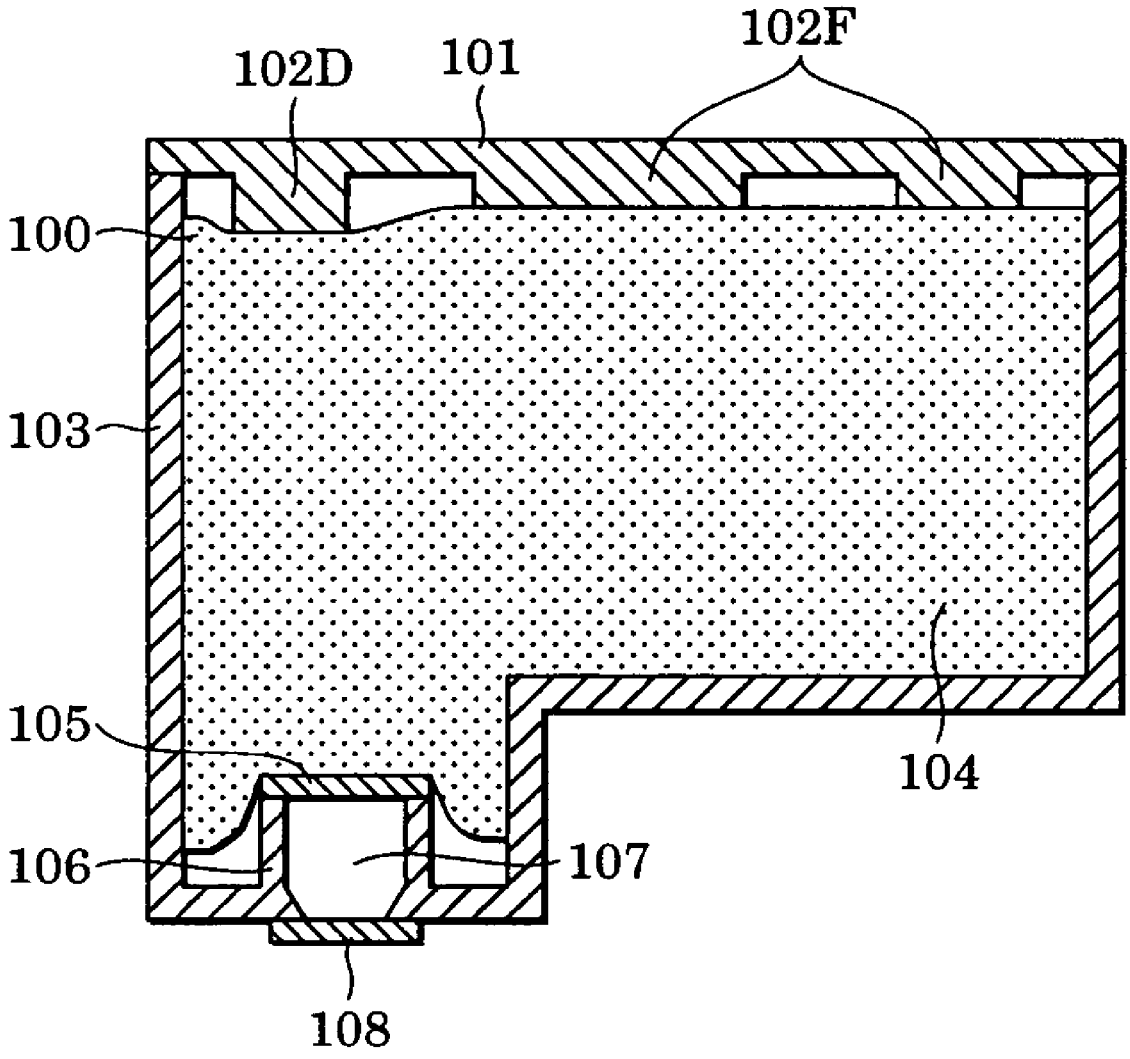
FIG. 1 is a sectional view of a black cartridge according to a first embodiment of the present invention.
Figure 2:
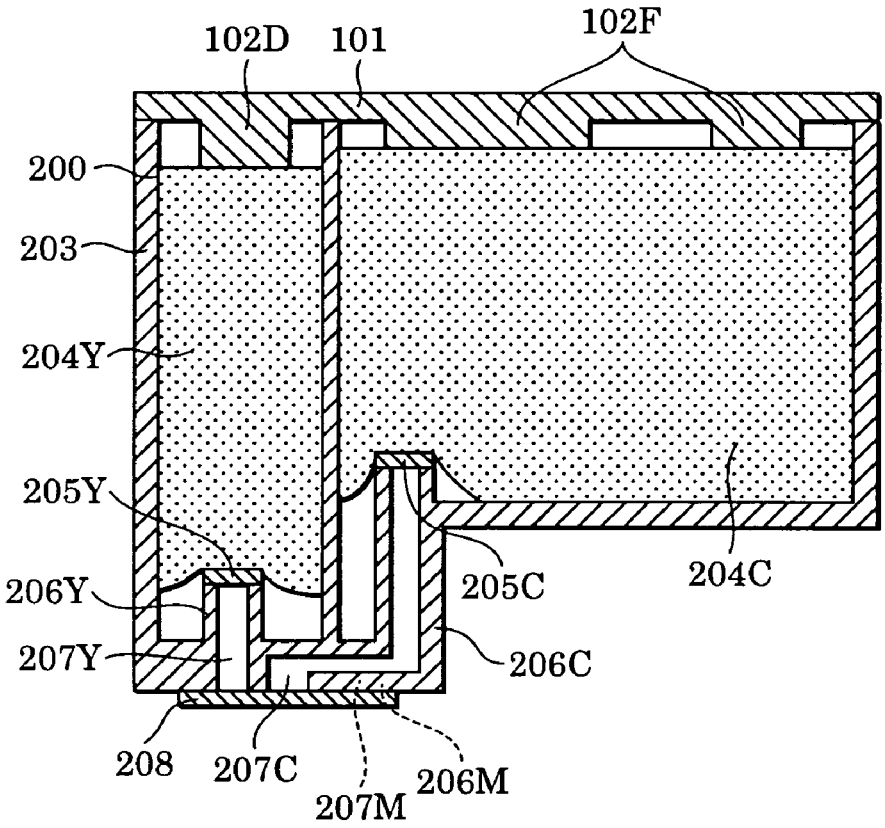
FIG. 2 is a sectional view of a color cartridge according to a first embodiment of the present invention.
Figure 3:
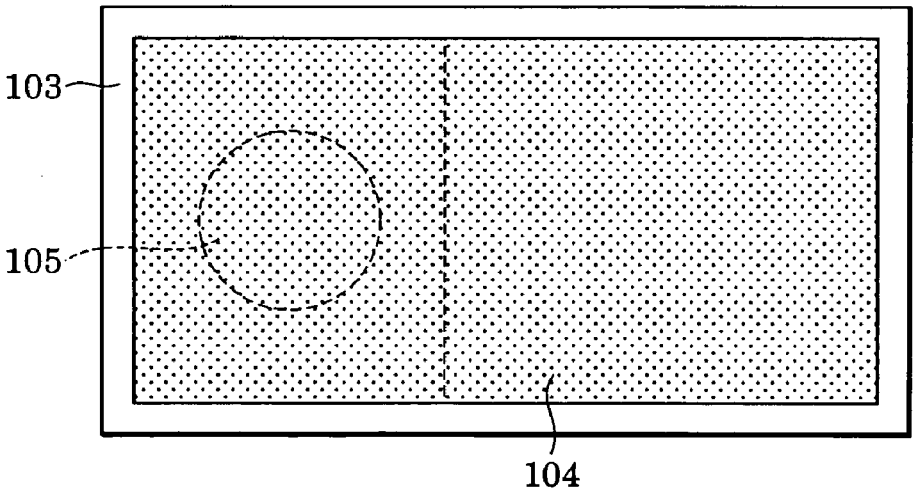
FIG. 3 is a plan view of the black cartridge in FIG. 1 as viewed from the side where the lid is removed.
Figure 4:
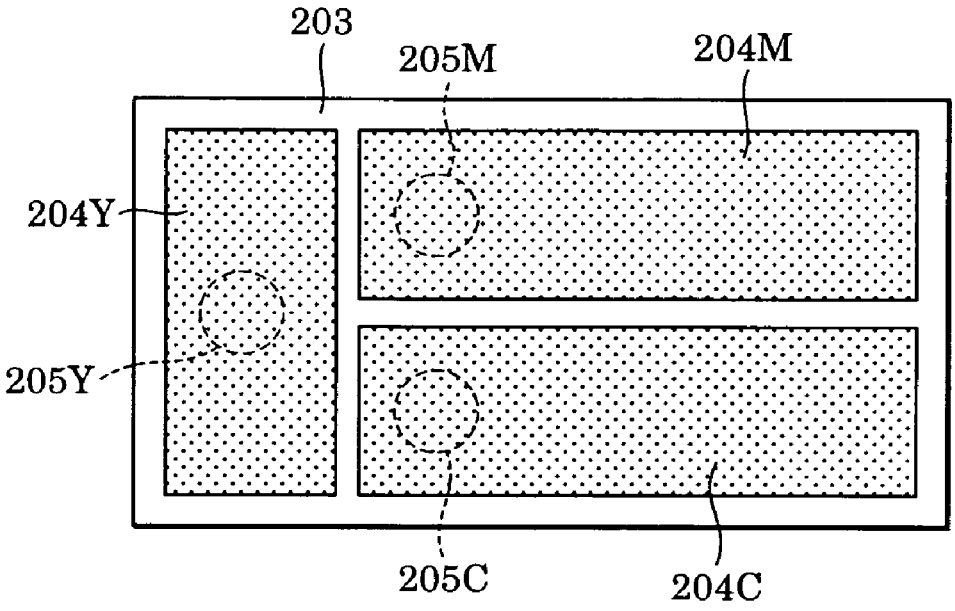
FIG. 4 is a plan view of the color cartridge in FIG. 2 as viewed from the side where the lid is removed.
Figure 5:
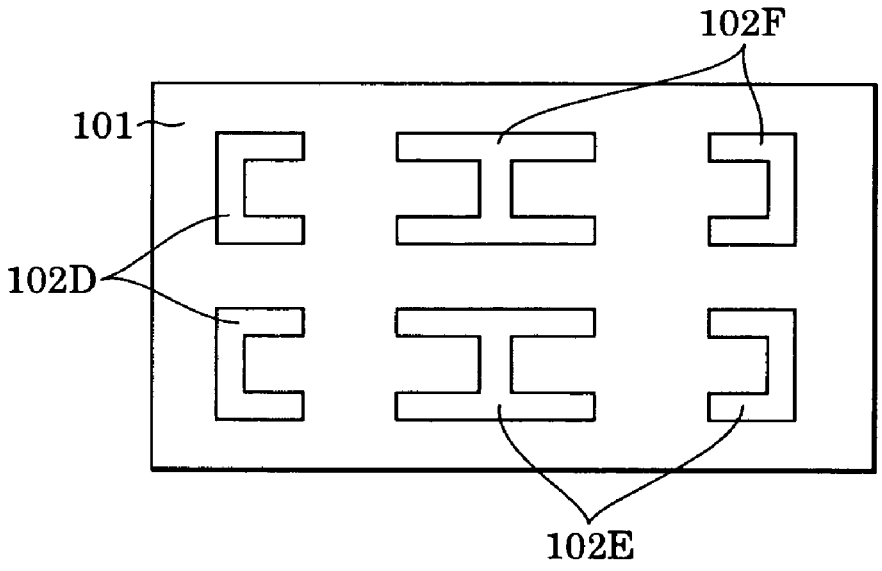
FIG. 5 is a plan view of the lid for the cartridges in FIGS. 1 and 2 as viewed from the side of its joint surface with the case.
Figure 6:
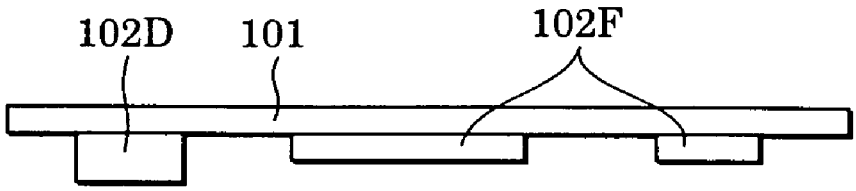
FIG. 6 is a side view of the lid in FIG. 5 as viewed from above in FIG. 5.
Figure 7:
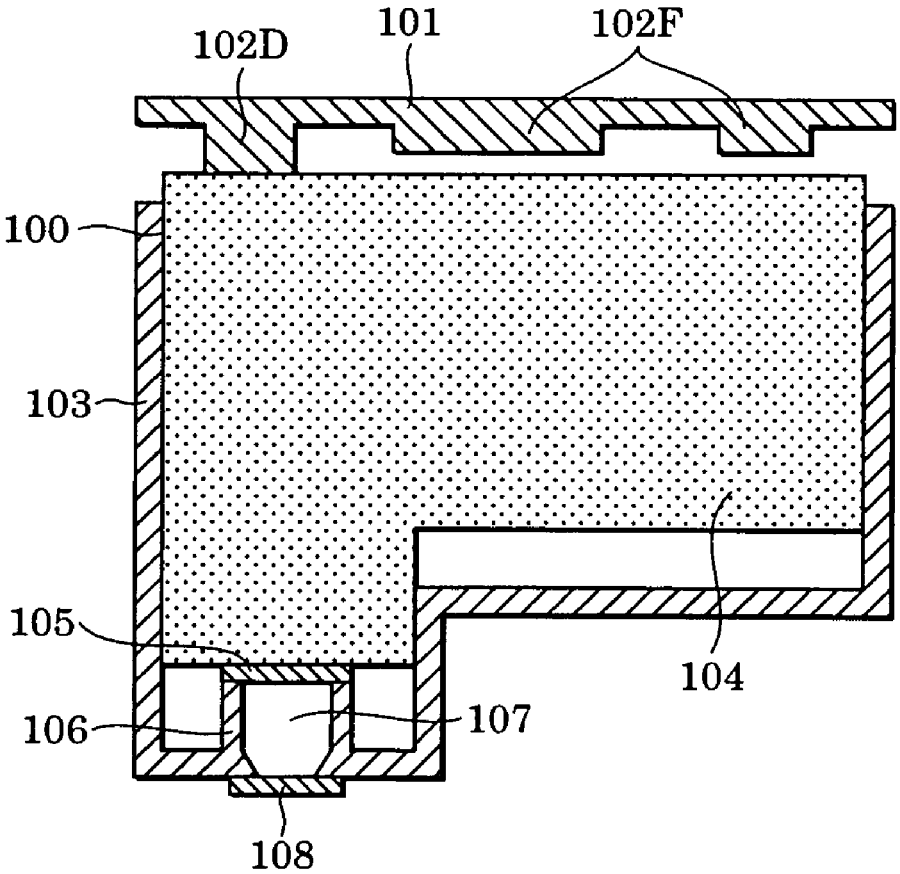
FIG. 7 is a sectional view of the black cartridge in FIG. 1 in its production process.

A first embodiment of the present invention is explained with reference FIGS. 1 to 7. FIGS. 1 and 2, respectively, are schematic sectional views of a black cartridge 100 and a color cartridge 200, each serving as an ink jet recording cartridge according to this embodiment. FIGS. 3 and 4, respectively, are plan views of the black cartridge and the color cartridge as viewed from the side where a lid 101 is removed. FIG. 5 is a plan view of the lid 101 as a single unit as viewed from the side of its joint surface with a case 103 or 203. FIG. 6 is a side view of the lid 101 as viewed from above in FIG. 5. Also, FIG. 7 is a sectional view showing a production process of the black cartridge 100 in FIG. 1.

The black cartridge 100 shown in FIG. 1 and other figures is a cartridge for a single color of black (B). An absorber 104 holding black ink is contained in an ink containing chamber formed of the case 103 and the lid 101. An ink jet recording head 108 is affixed on the bottom surface of the case 103. Also, in a bottom portion of the case 103, a cylindrical ink jet introducing section 106 that forms an ink flow path 107 connecting with an ink jet recording head 108 from the ink containing chamber, is provided in a position directly over the ink jet recording head 108 so as to project toward the ink containing chamber. At a front end portion projecting toward the ink containing chamber, of the ink introducing section 106, there is provided a filter 105. In the case 103, a top surface opposite to the bottom portion where the ink jet introducing section 106 is formed, is open, and this opening is blocked by the lid 101. On the bottom surface of the lid 101, ribs 102D, 102E, and 102F each having a predetermined planar pattern are formed so as to project downward, and abut against the top surface of the absorber 104.

The bottom portion of the case 103, where the ink jet recording head 108 is disposed, has a shape projecting downward from the other portions. The black cartridge 100 is mounted onto a carriage of the ink jet recording device, and is caused to discharge ink while being reciprocated on a recording medium. That is, it is used for performing main scanning. Therefore, forming only the portion where the ink jet recording head 108 is provided into a shape projecting downward, allows a hold-down member for holding down the recording medium to be arranged in the vicinity of a main scanning region, while allowing the ink jet recording head 108 to perform main scanning in close proximity to the recording surface of a recording medium. This makes it possible to appropriately set a flying distance and also stably hold the recording medium such as paper in the main scanning region, thereby achieving excellent recording quality.

Since the portion where the ink jet recording head 108 is disposed projects, the ink containing chamber has an L-shaped cross section. In order to use the inside of the ink containing chamber so as to be efficient in the containment of ink, one having an L-shaped cross section similar to the ink containing chamber is used as the absorber 104.

In this black cartridge 100, ink (not shown) held in the absorber 104 passes through the filter 105 provided at the front end of the ink introducing section 106, i.e., the inlet of the ink flow path 107, and is supplied to the ink jet recording head 108 through the ink flow path 107.

As shown in FIG. 7, the absorber 104 is inserted into the ink containing chamber from the opening on the top surface of the case 103, and thereafter, the lid 101 is welded and fixed to the case 103. At this time, particularly in its portion abutting against the ink introducing section 106, in a state of being subjected to no force, the absorber 104 is a little larger in the size in the height direction than the ink containing chamber. Accordingly, when the lid 101 is mounted, the absorber 104 has its top surface pressed by the ribs 102D, so that it is stably fixed. As a result, the portion opposite to the filter 105, on the undersurface of the absorber 104 is brought into pressure contact with the filter 105, thereby preventing air from entering the ink flow path 107 during ink supply. This prevention of the entry of air into the ink flow path 107 inhibits the reduction in the amount of ink supply and the interruption of ink supply and allows a stable ink supply, thereby maintaining satisfactory recording quality.

In particular, the black cartridge 100 is required to make the ink supply speed relatively high in order to meet high-speed printing requirements. For this purpose, the bore of the opening of the ink introducing section 106 is formed relatively large. The absorber 104, therefore, must be securely brought into pressure contact with the filter by applying a relatively large force to the filter 105. Since the shape of the cross section of the absorber 104 is L shape, it is difficult to apply a force to the abutting portion between the filter 105 and the absorber 104. Such being the case, the ribs 102D of the lid 101, located over the portion where the absorber 104 abuts against the filter 105, are formed a little higher than the other ribs 102E and 102F. As a result, at the position directly over the filter 105, the absorber 104 is pressed up to more depths, i.e., pressed more strongly than at the other portion, so that the absorber 104 can be brought into pressure contact with the filter 105 in stable and secure manners.

The color cartridge 200 shown in FIG. 2 and other figures is a cartridge supporting three colors of yellow (Y), magenta (M), and cyan (C). The inside of the case 203 of the color cartridge 200 is partitioned into three ink containing chambers by a T-shaped inner wall. Absorbers 204Y, 204M, and 204C, respectively, holding inks of yellow, magenta, and cyan colors are contained in the respective ink containing chambers. An ink jet recording head 208 is affixed on the bottom surface of the case 203. While not shown in detail, the ink jet recording head 208 has nozzles for each of the color inks, and is configured to selectively discharge each of the color inks in a desired pattern. Alternatively, the ink jet recording head 208 may be one formed by arranging heads for all three colors side by side.

The external shape of the color cartridge 200 is substantially the same as that of black cartridge 100. That is, the portion where the ink jet recording head 208 is provided in the bottom portion projects downward. Therefore, for example, the color cartridge 200 and black cartridge 100 can be mounted side by side on a common carriage therebetween.

In the bottom portion of the respective ink containing chambers, cylindrical ink jet introducing sections 206Y, 206M, and 206C that form ink flow paths 207Y, 207M, and 207C, respectively, are provided so as to project toward the respective ink containing chambers. At the front end portions projecting toward the respective ink containing chambers, there are provided filters 205Y, 205M, and 205C. The ink flow paths 207Y, 207M, and 207C bend as required, and connect with the introducing paths for respective color inks, of the ink jet recording head 208 (although not shown in detail).

Each of the ink containing chambers has a rectangular parallelepiped shape, and is located above the portion where the ink jet recording head 208 is disposed. The ink containing chamber for yellow color is longer in the height direction than those for the other colors. The absorbers 204Y, 204M, and 204C holding the respective inks have rectangular parallelepiped shapes corresponding to the respective ink containing chambers.

The color cartridge 200 also has the lid 101 in common with the black cartridge 100. The ribs 102D, 102E, and 102F of the lid 101 abut against the top surfaces of the absorbers 204Y, 204M, and 204C, respectively. The absorbers 204Y, 204M, and 204C are pressed downward by the ribs 102D, 102E, and 102F, respectively, and are thereby brought into pressure contact with the filters 205Y, 205M, and 205C, respectively. This prevents the entry of air into the ink flow paths 207Y, 207M, and 207C.

Basically, the ink supply operation in the color cartridge 200 is the same as that in the black cartridge 100. That is, the respective ink held in the absorbers 204Y, 204M, and 204C are supplied to the ink jet recording head 208 through the filters 205Y, 205M, and 205C, respectively, and then through the ink flow paths 207Y, 207M, and 207C, respectively.

Now, the ink jet recording cartridge according to this embodiment is mounted on a carriage of an ink jet recording device, and subjected to main scanning in the width direction (i.e., up-and-down directions in FIGS. 3 and 4). In order to allow the image formation across substantially the full width of a recording medium, the size in the width direction of the ink jet recording device requires at least a margin as much as the size of the width of the ink jet recording cartridge, in addition to the width of the recording medium. For this reason, the width of the ink jet recording cartridge has a significant influence on the size in the width direction of the ink jet recording device. Likewise, regarding the size in the depth direction (i.e., left-and-right directions in FIGS. 3 and 4), the region to undergo main scanning requires at least a space as much as the size in the depth direction of the ink jet recording cartridge, and hence, the size in the depth direction of the ink jet recording cartridge has a significant influence on the size in the depth direction of the ink jet recording device. The result is that, in order to reduce the installation space for the ink jet recording device, the ink jet recording cartridge is required to minimize the sizes in its width direction and depth direction.

When the sizes of the ink jet recording cartridge in the width direction and depth direction are reduced in this way, that is, its planar area is reduced, then, especially for the color cartridge 200 in which this narrow area is further divided into three, the areas of the absorbers 204Y, 204M, and 204C become small. With this being the situation, in order to maintain an excellent ink supply characteristic, it is desirable that the heights of the absorbers 204Y, 204M, and 204C be reduced below a certain level of height. For this purpose, the position of the top surface of the absorber 204Y disposed at the lower bottom portion in the case 203, is formed to be lower than the position of the top surface of each of the other absorbers 204M and 204C. It is therefore favorable that the ribs 102D abutting against the top surface of the absorber 204Y are higher than the other ribs 102E and 102F. That is, the positions of the lower end of the ribs 102D have become positions following the position of the top end of the absorber 204, and thereby the absorber 204Y can be appropriately brought into pressure contact with the filter 205Y.

In the color cartridge 200, the absorbers 204Y, 204M, and 204C have a rectangular parallelepiped shape. Also, the color cartridge 200 does not require so fast ink supply speed as compared with the black cartridge 100. In the color cartridge 200, therefore, the bores of the ink introducing sections 206Y, 206M, and 206C are smaller than that of the ink introducing section 106 of the black cartridge 106. Hence, in the color cartridge 200, even though the heights of ribs are uniform for each of the ink containing chambers, the absorbers can be brought into pressure contact with the filters in a sufficiently secure manner.

As described above, it is required of the lid 101 in common between the black cartridge 100 and the color cartridge 200 of this embodiment that the height of the ribs 102D at the positions directly over the lower bottom portion in each of the cases 103 and 203 with the similar external shapes is lower than those of the other ribs 102E and 102F. This embodiment can suitably use the same lid 101 for the black cartridge 100 and the color cartridge 200 to meet the above-described requirement. Using the common lid between the black cartridge 100 and color cartridge 200 in this way allows production efficiency of the ink jet recording cartridge to be improved, resulting in a reduced production cost.

Figure 8:
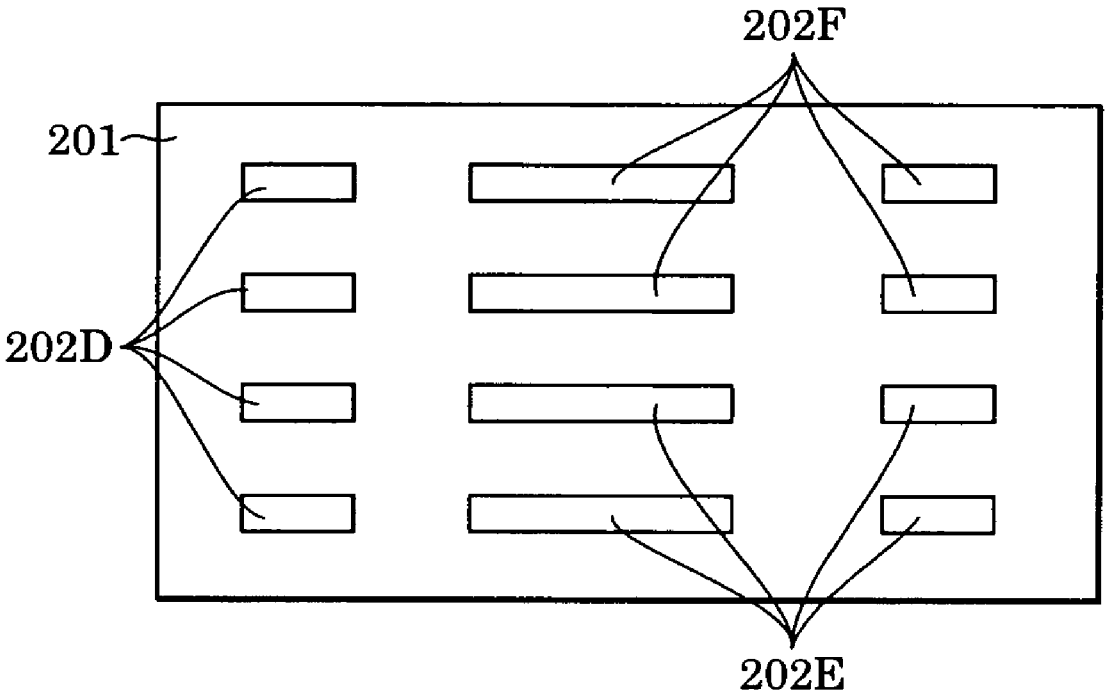
FIG. 8 is a plan view of a lid of a modification of the first embodiment as viewed from the side of its joint surface with the case.
Figure 9:
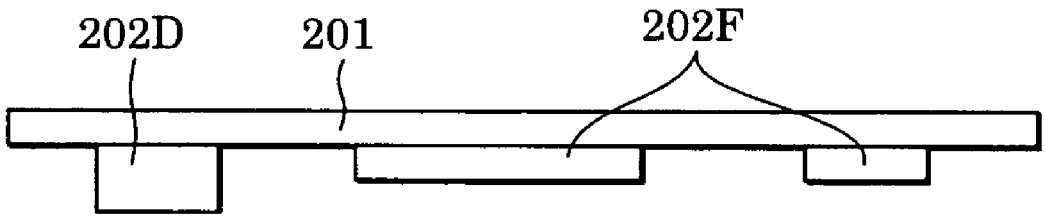
FIG. 9 is a side view of the lid in FIG. 8 as viewed from above in FIG. 8.

The present embodiment is for illustrative purposes only, and it is to be understood that various changes and modifications may be made in the present invention within its spirit and scope. The common lid between the black cartridge 100 and the color cartridge 200 is not limited to the lid shown in FIGS. 5 and 6, but, for example, a lid 201 in which ribs are formed of patterns shown in FIGS. 8 and 9 may also be employed as a shared lid. In this lid 201 also, ribs 202D located directly over the lower bottom portion, in the cases 103 and 203, are higher than the other ribs 202E and 202F. In general, the lid that can be used as a common lid between the black cartridge 100 and the color cartridge 200 is such that, when used for the color cartridge 200, the lid abuts against the top surface of each of the absorbers 204Y, 204M, and 204C, that its ribs at positions directly over the lower bottom portion are higher than the other ribs, and that all its ribs are formed of patterns in a range where they do not interfere with the inner wall of the case 203.

The shape of each of the cases 103 and 203 is not limited to one whose cross sectional shape is an L shape, but any shape whose bottom portion is lower anywhere may be used. Liquids to be discharged from the ink jet recording heads 108 and 208 are not restricted to ink, but various reaction liquids may be used. The ink jet recording cartridges employing a shared lid is not restricted to the black cartridge 100 and color cartridge 200. In general, it is possible to achieve commonality of lid among a plurality of kinds of ink jet recording cartridges different in the number of ink containing chambers (liquid containing chambers).

Second Embodiment

Figure 10:
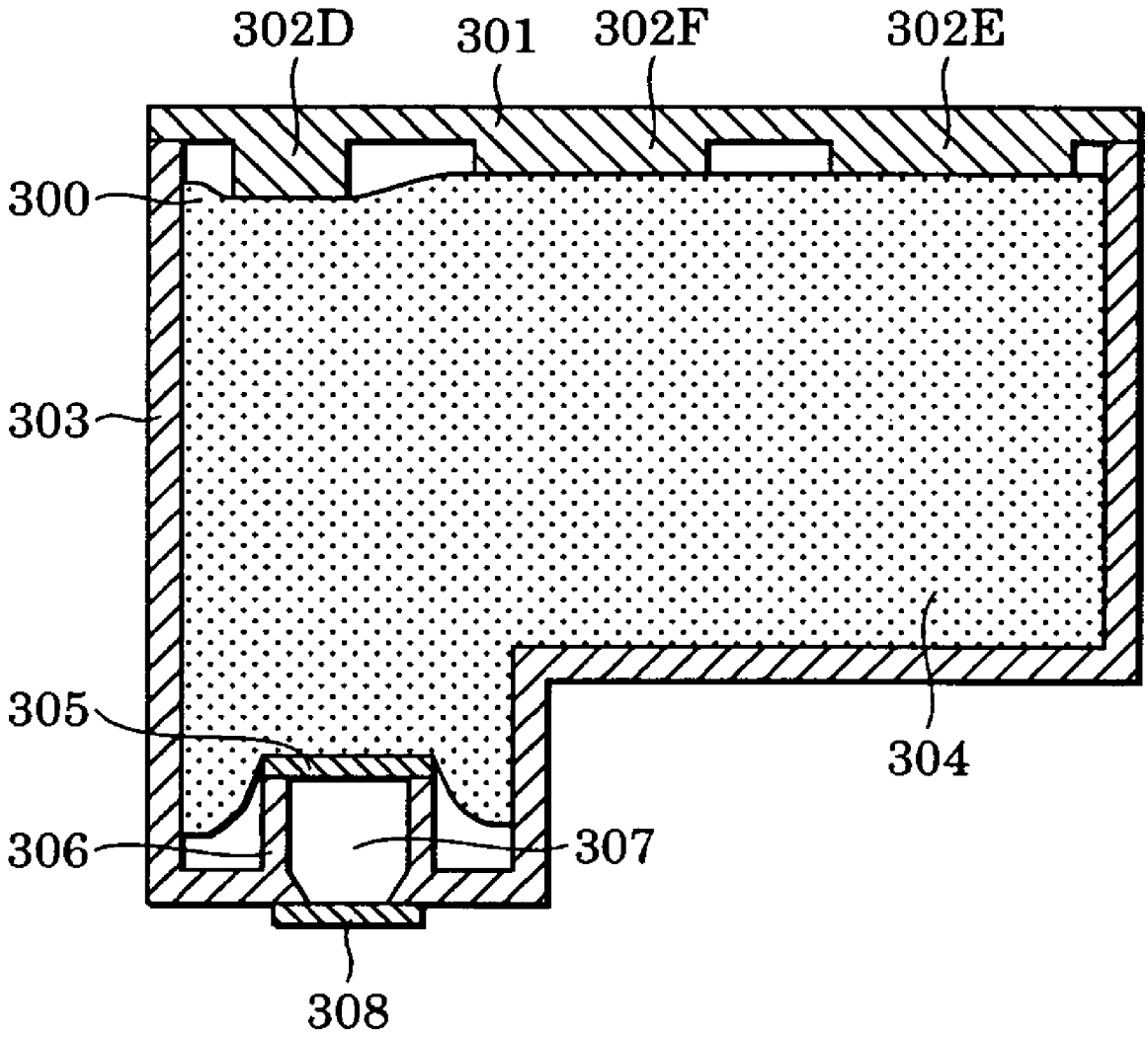
FIG. 10 is a sectional view of a black cartridge according to a second embodiment of the present invention.
Figure 11:
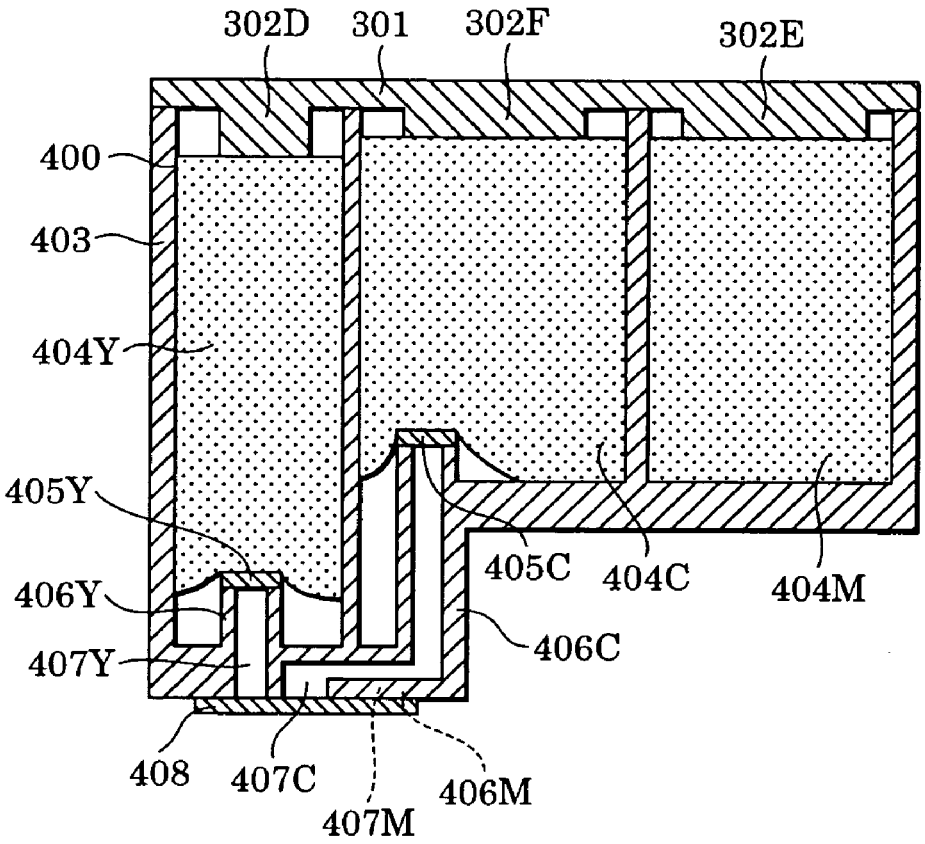
FIG. 11 is a sectional view of a color cartridge according to a second embodiment of the present invention.
Figure 12:
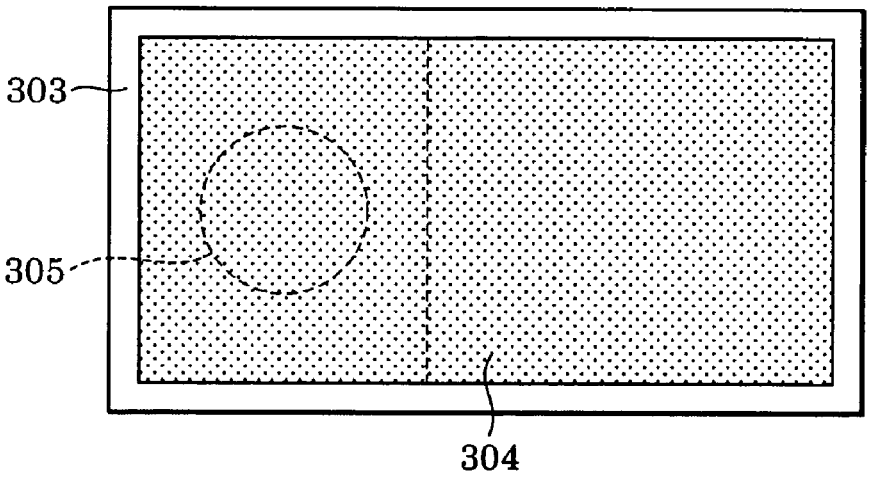
FIG. 12 is a plan view of the black cartridge in FIG. 10 as viewed from the side where a lid is removed.
Figure 13:
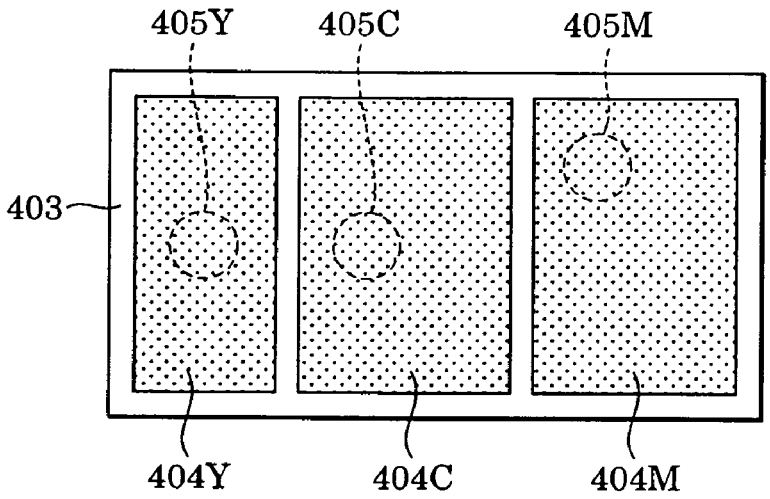
FIG. 13 is a plan view of the color cartridge in FIG. 11 as viewed from the side where the lid is removed.
Figure 14:
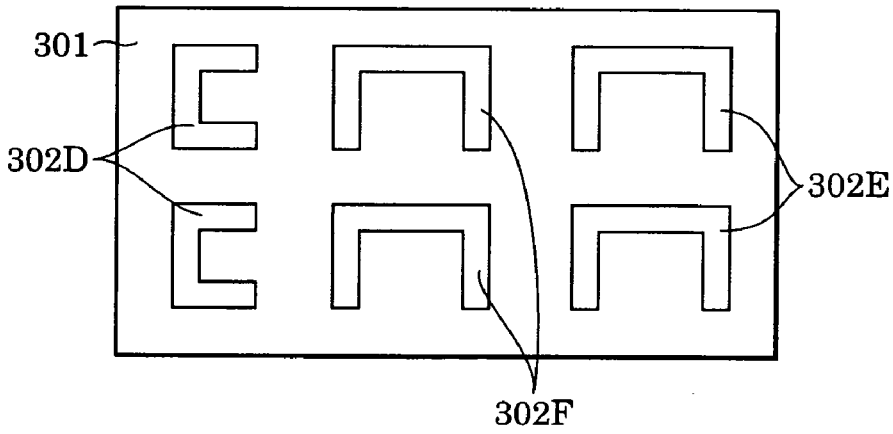
FIG. 14 is a plan view of the lid for the cartridges in FIGS. 10 and 11 as viewed from the side of its joint surface with the case.
Figure 15:
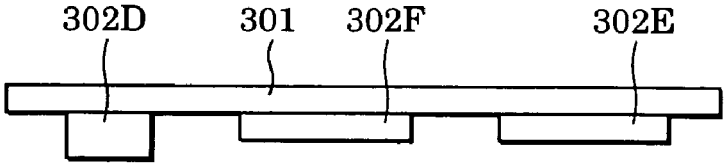
FIG. 15 is a side view of the lid in FIG. 14 as viewed from above in FIG. 14.
Figure 16:
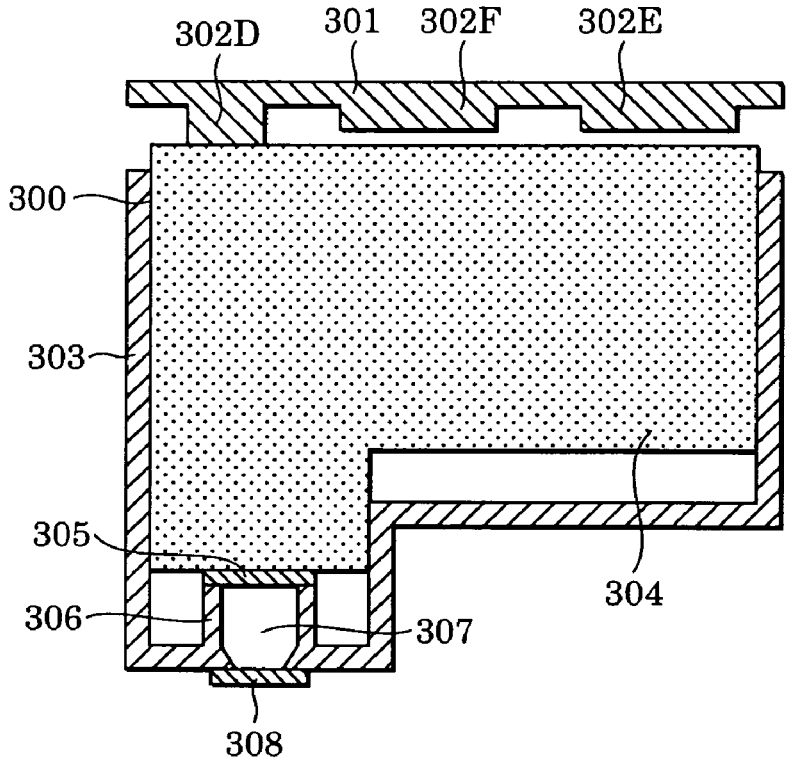
FIG. 16 is a sectional view of the black cartridge in FIG. 10 in its production process.

Next, a second embodiment according to the present invention will be described with reference to FIGS. 10 to 16. FIGS. 10 and 11, respectively, are schematic sectional views of a black cartridge 300 and a color cartridge 400, each serving as an ink jet recording cartridge according to this embodiment. FIGS. 12 and 13, respectively, are plan views of the black cartridge and the color cartridge as viewed from the side where a lid 301 is removed. FIG. 14 is a plan view of the lid 301 as a single unit as viewed from the side of its joint surface with a case 303 or 403. FIG. 15 is a side view of the lid 301 as viewed from above in FIG. 14. Also, FIG. 16 is a sectional view showing a production process of the black cartridge 300 in FIG. 10.

In this embodiment also, the black cartridge 300 and the color cartridge 400 have the same external shape, that is, the bottom portions where respective ink jet recording heads 308 and 408 are provided, are lower than the respective other bottom portions. Therefore, a hold-down member for the recording medium can be provided on both sides of the ink jet recording head 308 or 408 in the vicinity of the main scanning region, thereby allowing satisfactory recording quality to be obtained.

The ink supply operations in the black cartridge 300 and the color cartridge 400 are the same as that in the first embodiment. That is, respective inks held in absorbers 304, 404Y, 404M and 404C are supplied to the ink jet recording head 308 and 408, respectively, through filters 305 and 405Y, 405M and 405C that are affixed to front ends of ink introducing sections 306, 406Y, 406M and 406C, respectively, and then through ink flow paths 307, 407Y, 407M and 407C, respectively.

As in the case of the first embodiment, in the black cartridge 300, the absorber 304 has an L shape in conformance with the shape of the case 303 in order to increase the ink containment efficiency. Also, the ink introducing section 306 has a large bore to meet the high-speed printing requirement. Here, in order to securely bring the absorber 304 into pressure contact with the filter 305, ribs 302D of the lid 301, located in the vicinity of a position directly over the filter 305 are formed to be higher than ribs 302E and 302F. This prevents the entry of air into the ink flow path 307, and allows the ink to be stably supplied without causing interruption of ink supply, thereby maintaining excellent recording quality.

In the color cartridge 400, ink containing chambers for three color inks of yellow, magenta, and cyan are formed side by side. By using the lid 301, which is to be shared with the black cartridge 300, for the color cartridge 400, ribs 302D, 302E, and 302F abut against the top surfaces of the absorbers 404Y, 404M, and 404C, respectively.

Out of the ink containing chambers of the color cartridge 400, the ink containing chamber for yellow ink is located above the lower bottom portion in the case 403, and consequently the position of the top surface of the absorber 404Y for yellow ink is lower than the other absorbers 404C and 404M. This is because, as in the case of the first embodiment, the width and depth of the color cartridge 400 are each reduced to a small value in order to restrain the footprint of the ink jet recording device to a small value.

Because the absorber 404Y and the absorbers 404M and 404C have different top surface heights, the ribs 302D are higher than the other ribs 302E and 302F in the lid 301. That is, the positions of the lower ends of the ribs 302D have become positions following the position of the top end of the absorber 404Y, and so that the ribs 302D can appropriately press the absorber 404Y to bring it into pressure contact with the filter 405Y. Also, the absorbers 404Y, 404M, and 404C have a rectangular parallelepiped shape, and the bore of each of the ink introducing sections 406Y, 406M, and 406C are smaller than that of the ink introducing section 306 of the black cartridge. Hence, in the color cartridge 400, even though the heights of ribs are uniform for each of the ink containing chambers, the absorbers 404Y, 404M, and 404C, respectively, can be brought into contact with the filters 405Y, 405M, and 405C in a sufficiently secure manner.

As described above, in this embodiment also, since the construction conditions required of the lid 301 are common between the black cartridge 300 and the color cartridge 400, the shared lid 301 therebetween can be suitably employed.

Figure 17:
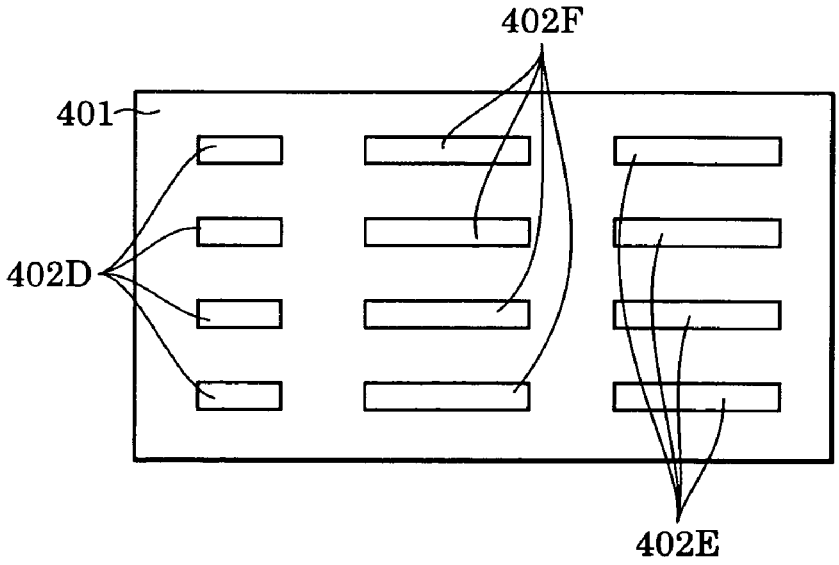
FIG. 17 is a plan view of the lid of a modification of the second embodiment as viewed from the side of its joint surface with the case.
Figure 18:
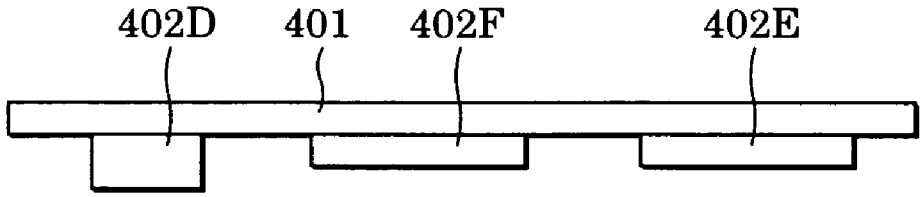
FIG. 18 is a side view of the lid in FIG. 17 as viewed from above in FIG. 17.

The common lid between the black cartridge 300 and the color cartridge 400 is not limited to the lid shown in FIGS. 14 and 15, but a lid 401 shown in FIGS. 17 and 18 may also be used as a common lid therebetween. In this lid 401 also, ribs 402D located directly over the lower bottom portion in the cases 303 and 403, are higher than the other ribs 402E and 402F. In general, the lid that can be used as a common lid between the black cartridge 300 and the color cartridge 400 is such that, when used for the color cartridge 400, the lid abuts against the top surface of each of the absorbers 204Y, 204M, and 204C, that its ribs at positions directly over the lower bottom portion in each of the cases 303 and 403 are higher than the other ribs, and that all its ribs are formed of patterns in a range where they do not interfere with the inner wall of the case 403.

Third Embodiment

Figure 19:
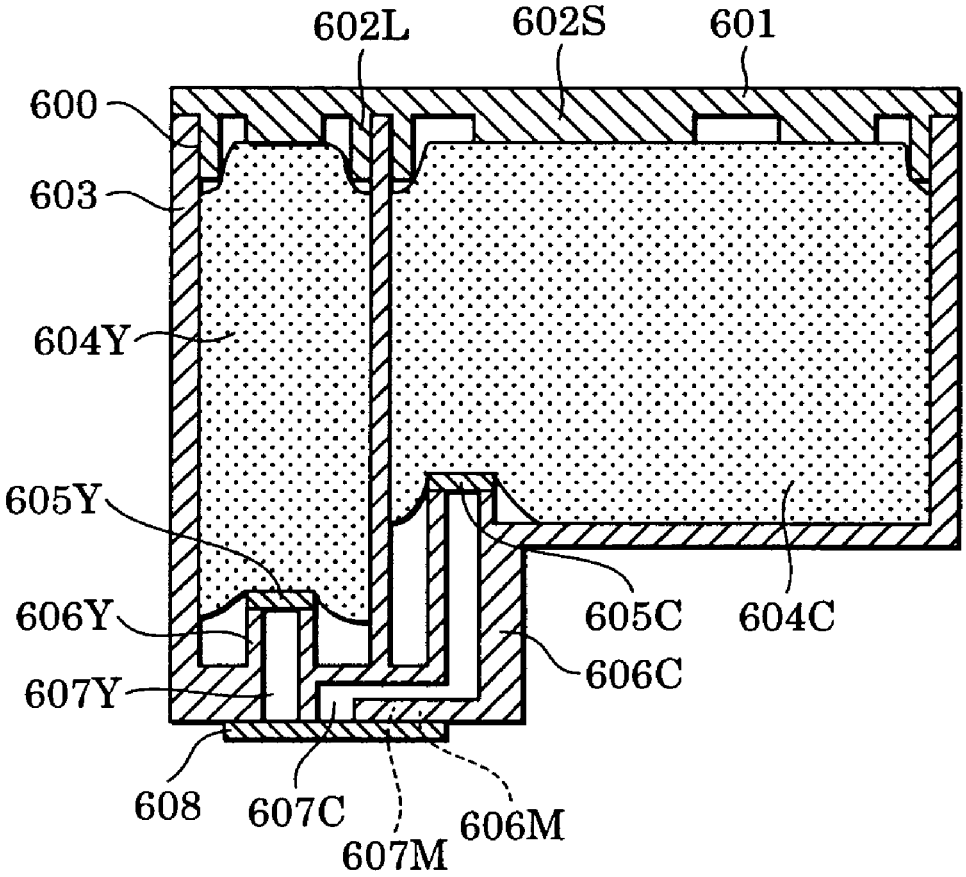
FIG. 19 is a sectional view of a color cartridge according to a third embodiment of the present invention.
Figure 20:
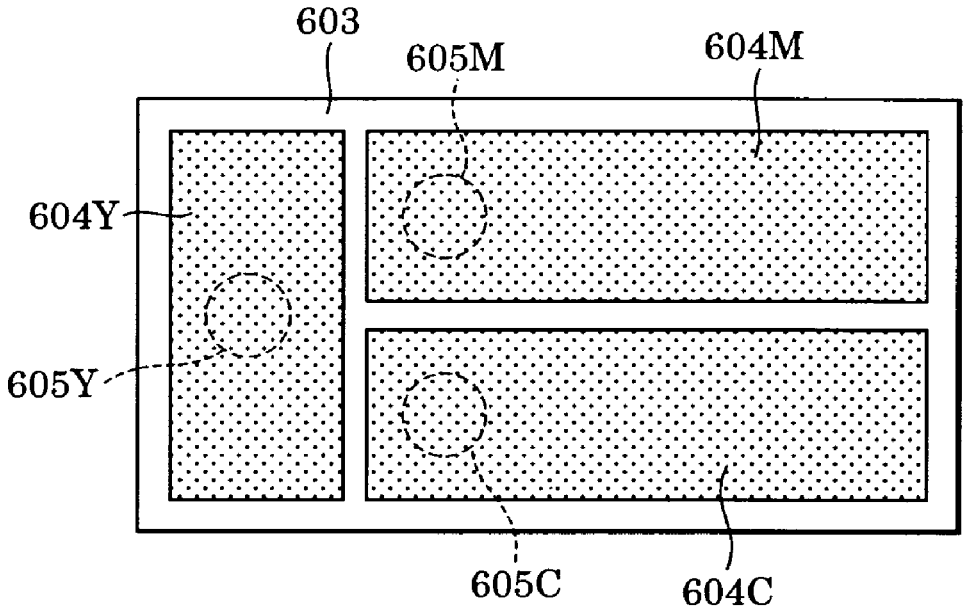
FIG. 20 is a plan view of the color cartridge in FIG. 19 as viewed from the side where the lid is removed.
Figure 21:
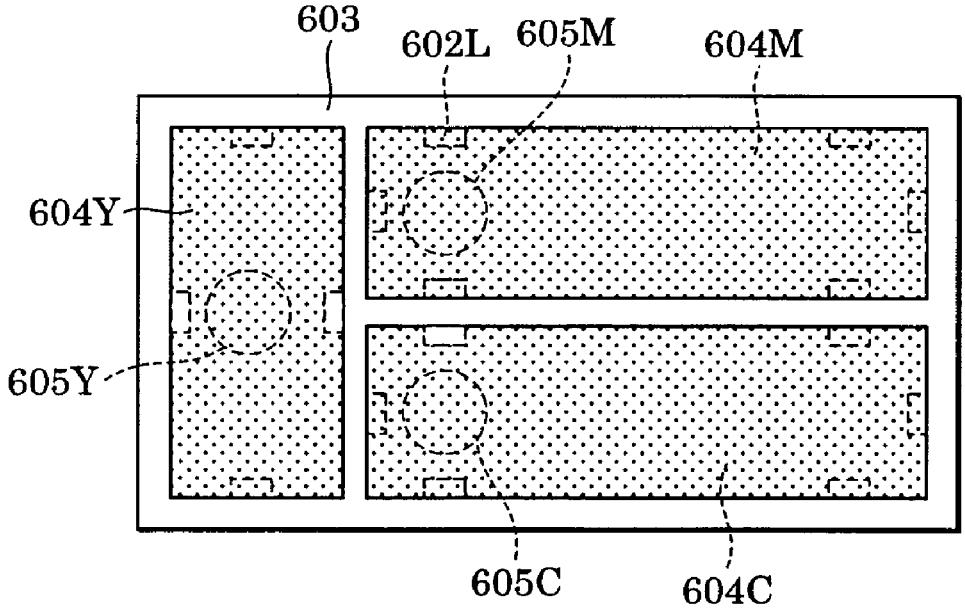
FIG. 21 is a plan view showing abutting positions of ribs of the lid in the color cartridge in FIG. 19.
Figure 22:
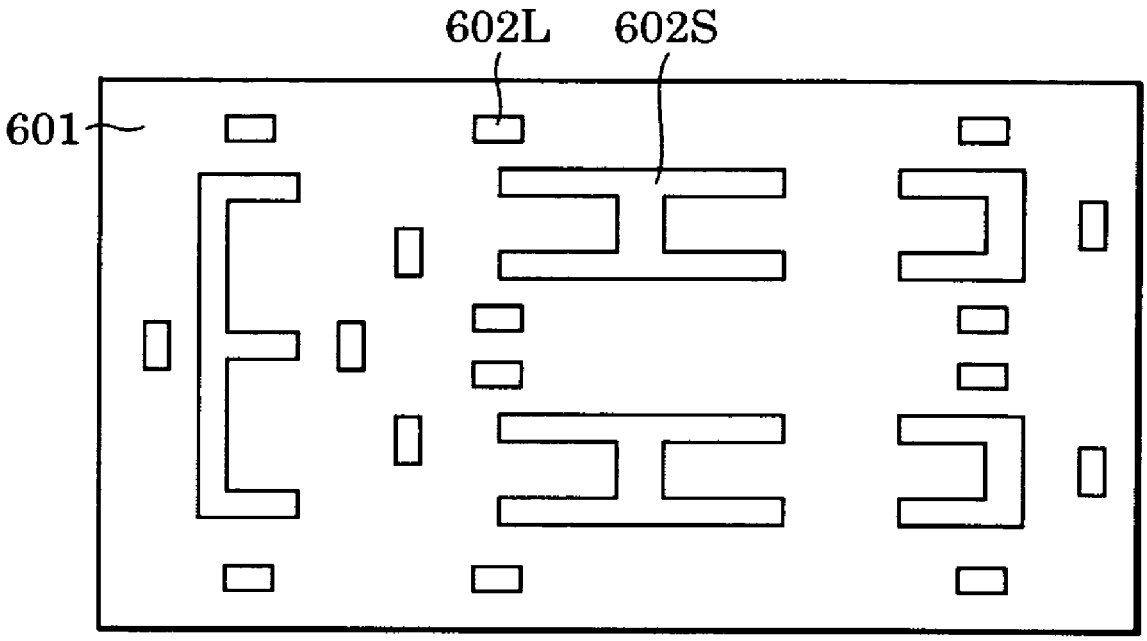
FIG. 22 is a plan view of the lid of the color cartridge in FIG. 19 as viewed from the side of its joint surface with the case.
Figure 23:
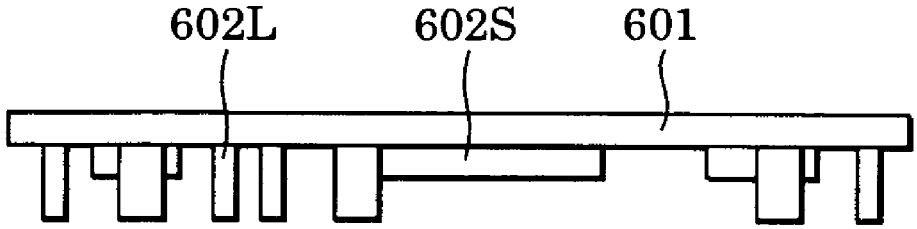
FIG. 23 is a side view of the lid un FIG. 22 as viewed from above in FIG. 22.
Figure 24:
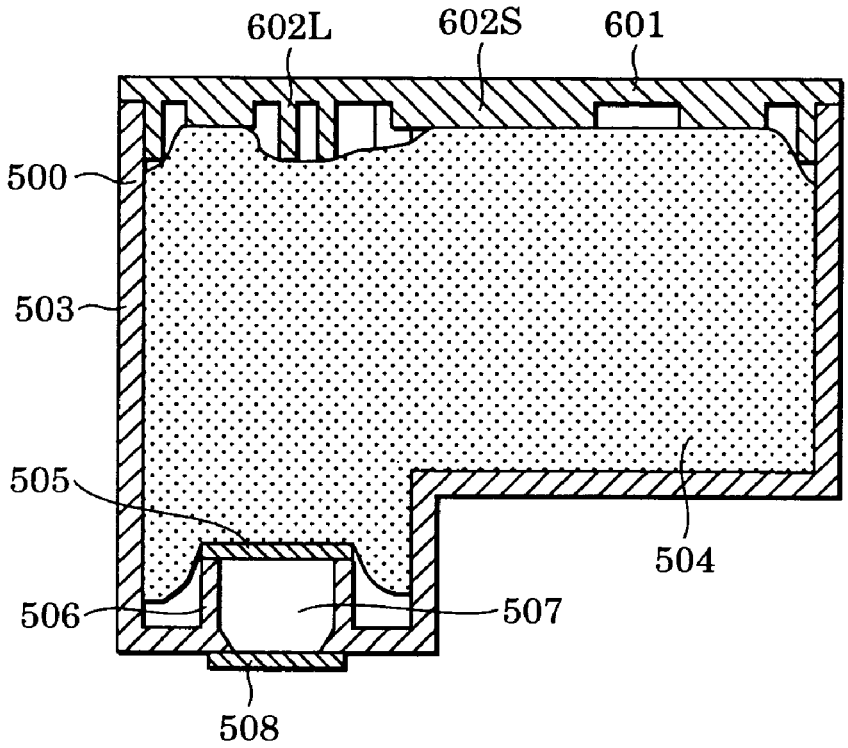
FIG. 24 is a sectional view of a black cartridge according to a third embodiment of the present invention.
Figure 25:
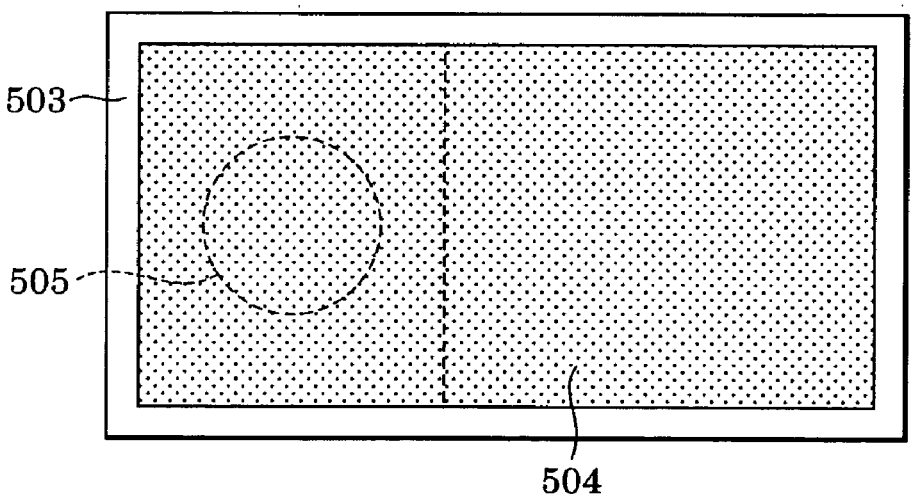
FIG. 25 is a plan view of the black cartridge in FIG. 24 as viewed from the side where a lid is removed.
Figure 26:
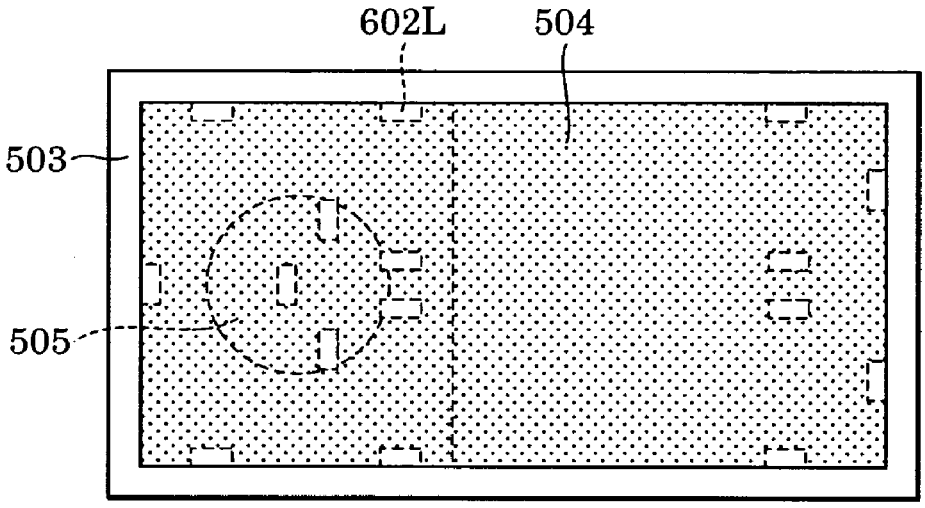
FIG. 26 is a plan view showing abutting positions of ribs of the lid in the black cartridge in FIG. 24.
Figure 27:
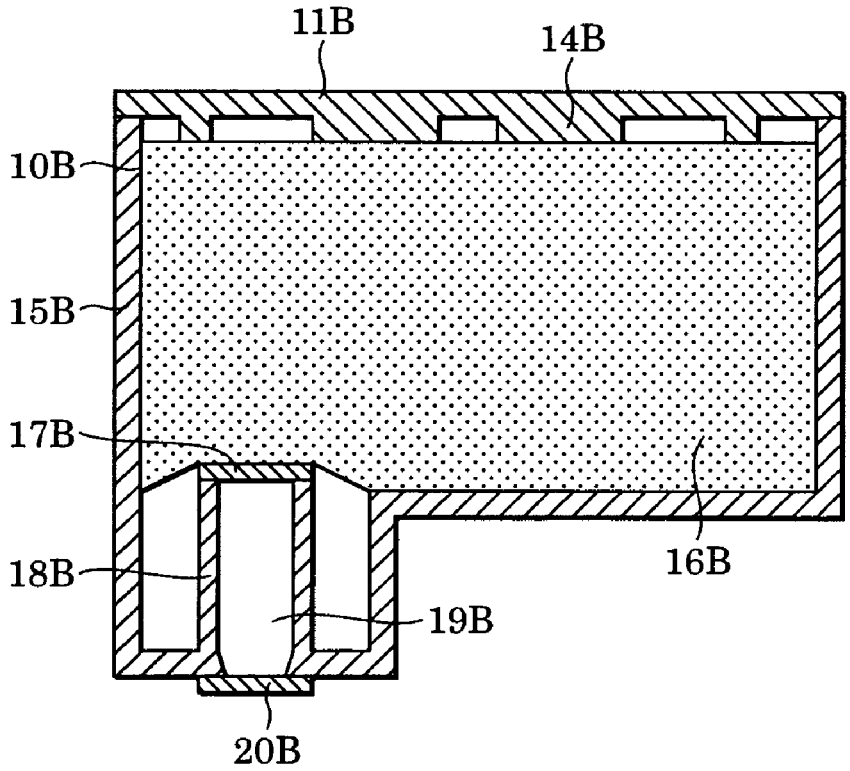
FIG. 27 PRIOR ART
FIG. 27 is a sectional view of a conventional black cartridge.
Figure 28:
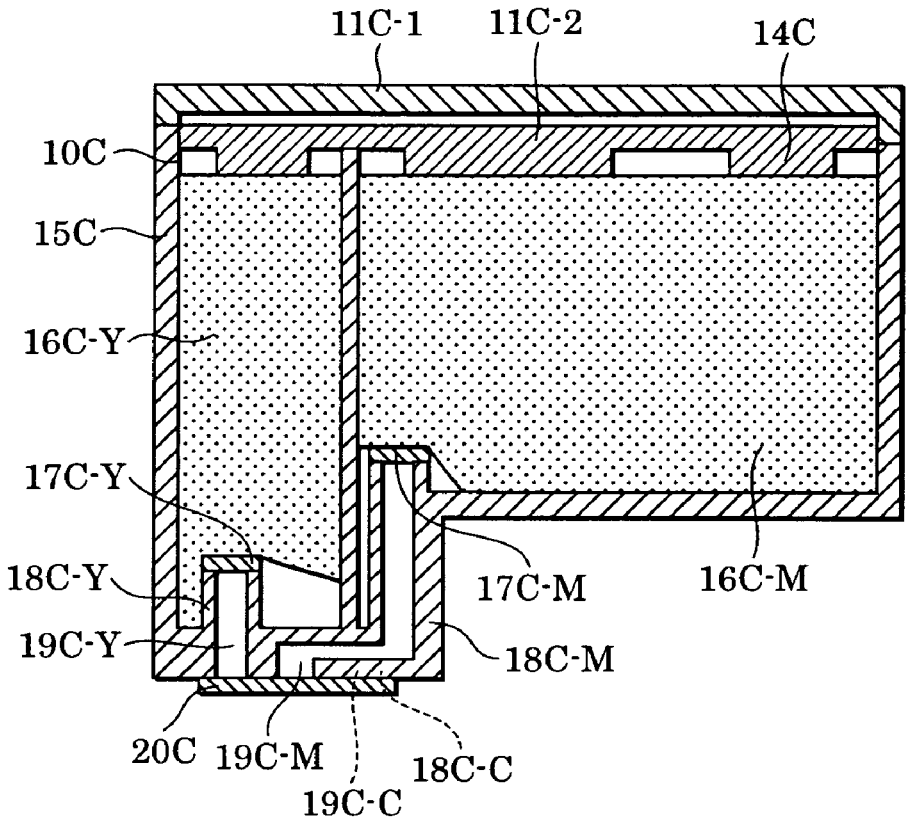
FIG. 28 PRIOR ART
FIG. 28 is a sectional view of a conventional color cartridge.
Figure 29:
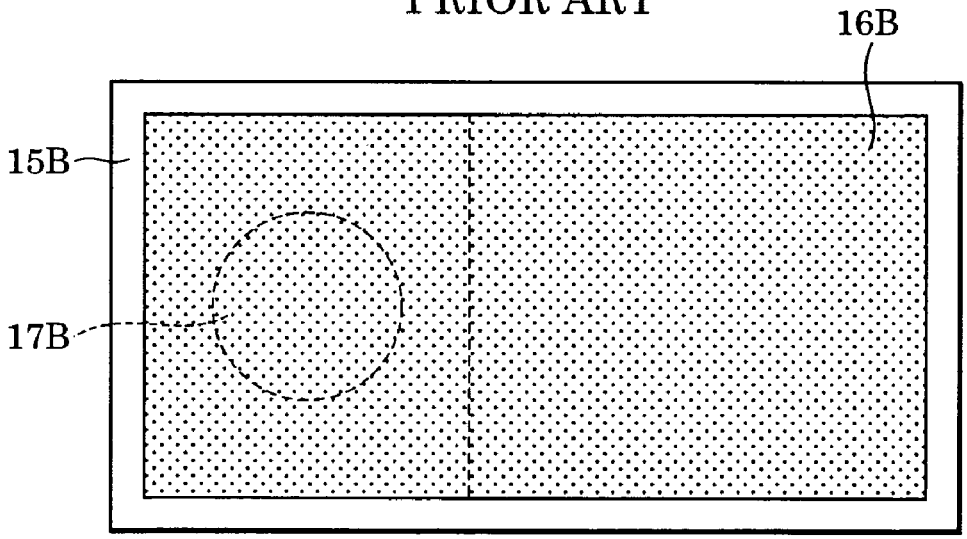
FIG. 29 PRIOR ART
FIG. 29 is a plan view of the black cartridge in FIG. 27 as viewed from the side where a lid is removed.
Figure 30:
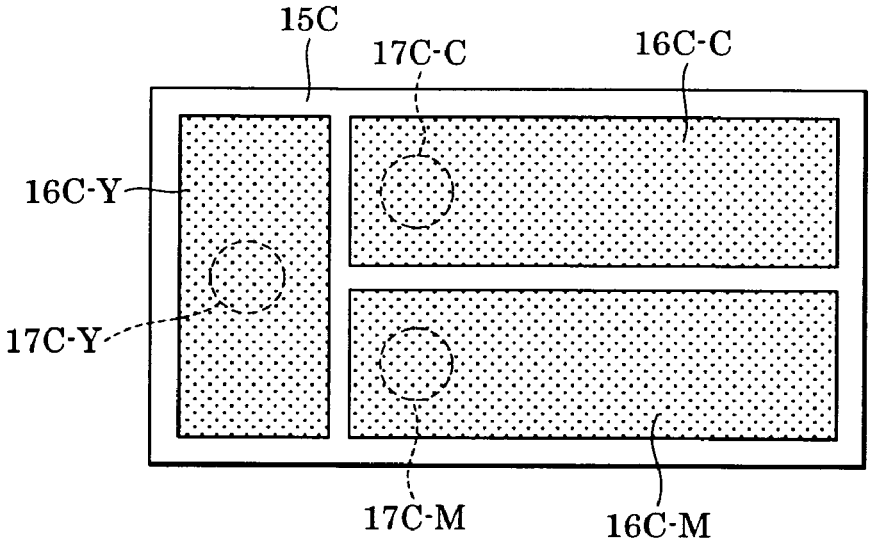
FIG. 30 PRIOR ART
FIG. 30 is a plan view of the color cartridge in FIG. 28 as viewed from the side where a lid is removed.
Figure 31:
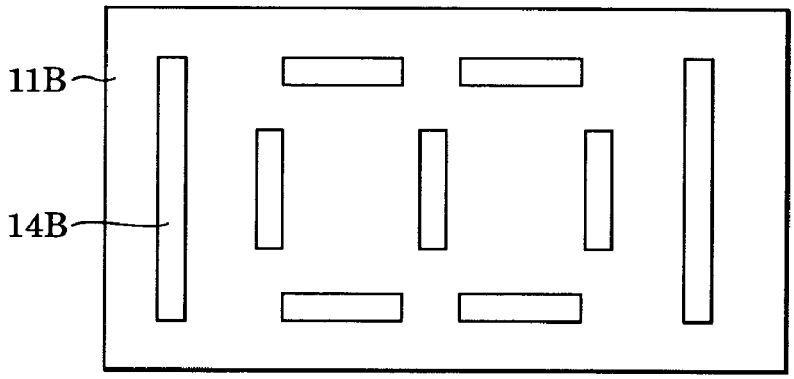
FIG. 31 PRIOR ART
FIG. 31 is a plan view of the lid of the black cartridge in FIG. 27 as viewed from the side of its joint surface with the case.
Figure 32:
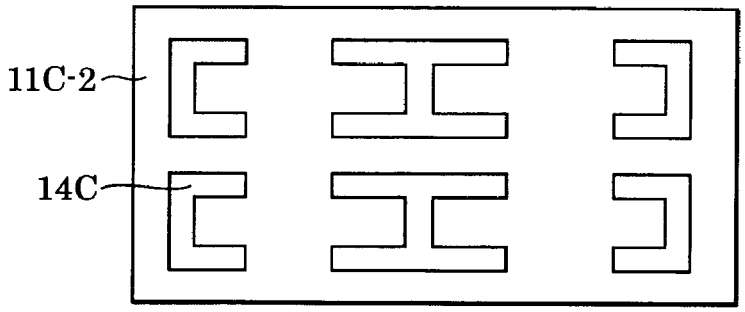
FIG. 32 PRIOR ART
FIG. 32 is a plan view of the inner lid of the color cartridge in FIG. 28 as viewed from the side of its joint surface with the case.
Figure 33:
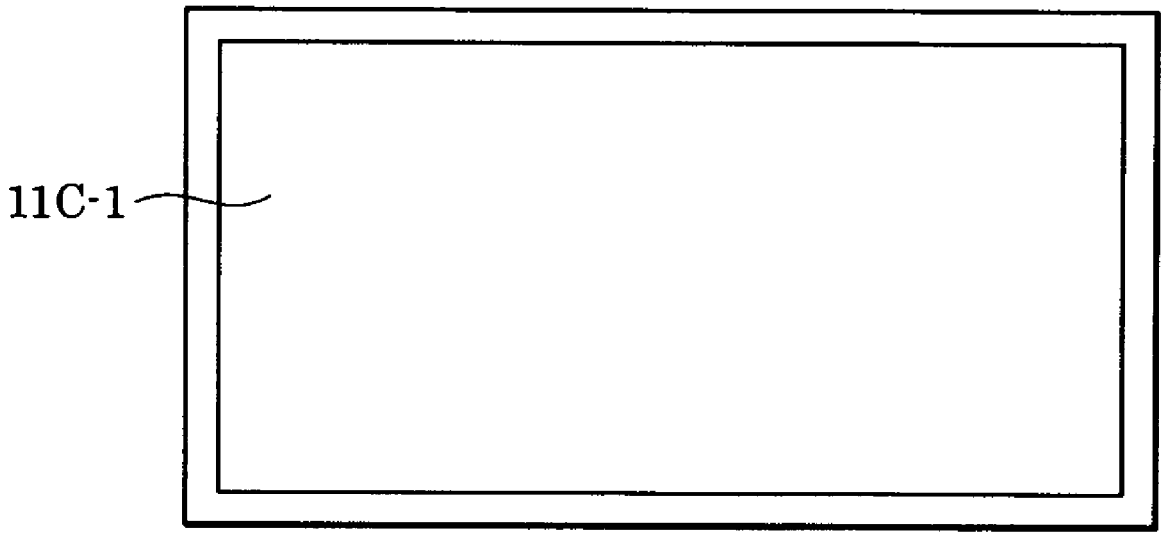
FIG. 33 PRIOR ART
FIG. 33 is a plan view of the outer lid of the color cartridge in FIG. 28 as viewed from the side of its joint surface with the case.

Next, a third embodiment according to the present invention will be described with reference to FIGS. 19 to 26. FIGS. 19 and 24, respectively, are schematic sectional views of a color cartridge 600 and a black cartridge 500, each serving as an ink jet recording cartridge according to this embodiment. FIGS. 20 and 25, respectively, are plan views of the color cartridge 600 and the black cartridge 500 as viewed from the side where a common lid 601 therebetween is removed. FIGS. 21 and 26 are plan views showing abutting positions of ribs 602L of the lid 601 in the color cartridge 600 and the black cartridge 500, respectively. FIG. 22 is a plan view of the lid 601 as a single unit as viewed from the side of its joint surface with a case 603 or 503. Also, FIG. 23 is a side view of the lid 601 as viewed from above in FIG. 22.

In this embodiment also, the black cartridge 500 and the color cartridge 600 have the same external shape, that is, the bottom portions where respective ink jet recording heads 508 and 608 are provided, are lower than the respective other bottom portions. Therefore, a hold-down member for the recording medium can be provided on both sides of the ink jet recording head 508 or 608 in the vicinity of the main scanning region, thereby achieving satisfactory recording quality.

The ink supply operations in the black cartridge 500 and the color cartridge 600 are the same as that in the first and second embodiments. That is, respective inks held in absorbers 504, 604Y, 604M and 604C are supplied to the ink jet recording heads 508 and 608, respectively, through filters 505, 605Y, 605M and 605C that are affixed to the front ends of ink introducing sections 506, 606Y, 606M and 606C, respectively, and then through ink flow paths 507, 607Y, 607M and 607C, respectively.

As in the case of the first embodiment, the inside of the case 603 of the color cartridge 600 is partitioned by a T-shaped inner wall into three ink containing chambers for yellow, magenta, and cyan colors. As in the cases of the first and second embodiments, the lid 601 jointed to this case 603 has ribs 602S that abut against the vicinities of the center of the top surfaces of the absorbers 604Y, 604M, and 604C. The absorbers 604Y, 604M, and 604C are pressed by the ribs 602S and brought into pressure contact with the filters 605Y, 605M, and 605C, respectively. This prevents the entry of air into the ink flow paths 607Y, 607M, and 607C, and allows the inks to be stably supplied without causing interruption of ink supply, thereby maintaining excellent recording quality.

In this embodiment, the lid 601 further has ribs 602L disposed at positions higher than the ribs 602S and along the periphery of each of the ink containing chambers. These ribs 602S perform the function of preventing the absorber 604Y, 604M, and 604C from running over the respective ink containing chambers during the production process of cartridge. Specifically, when using particularly an absorber to be inserted into a case while being compressed, if the absorber is pushed in while the vicinity of the central portion of its top surface is pressed, the peripheral portion of the absorber is likely to be left without being much compressed during the pushing-in process. As a result, the peripheral portion of the absorber may undesirably get caught in the gap between the lid and the case. In this situation, because there is a possibility of impairing junction between the lid and case by e.g., supersonic welding, it is necessary to produce the cartridge with due care to avoid causing such an occurrence. Accordingly, providing the lid 601 with the ribs 602L that are to abut against the peripheral portion of the top surface of each of the absorbers prior to abutting against the ribs 602S allows the peripheral portion of each of the absorbers to be reliably pushed into the respective ink containing chambers, thereby reliably preventing the running over of each of the absorbers to facilitate the production of cartridge.

In this embodiment, the lid 601 is also used for the black cartridge 500. Here, the ribs 602L abut against the periphery of the top surface of the absorber 504, and thereby, as in the case of the color cartridge 600, they can prevent the absorber 504 from running over the ink containing chamber during the production process of the cartridge. Furthermore, out of the ribs 602L, one positioned in the vicinity of the central branch portion of the T-shaped inner wall is located in the vicinity of the position directly over the filter 505 as can be seen from FIG. 26, so that the absorber 504 can be pushed more deeply into the vicinity of the position directly over the filter 505 than into the other portions.

As described in the first and second embodiments, in the black cartridge 500, the ink containing chamber has an L-shaped cross section, and the ink introducing section 506 has a large bore to meet the high-speed printing requirement. Therefore, the absorber 504 can be pushed more deeply into the vicinity of the position directly over the filter 505 than into the other portions. This allows the absorber 504 to be securely brought into pressure contact with the filter 505 disposed at the front end of the ink introducing section 506, thereby effectively preventing the entry of air into the ink flow path 507.

As is evident from the foregoing, in this embodiment, the common lid 601 between the color cartridge 600 and the black cartridge 500 can be suitably employed. To sum up, when the lid 601 is used for the color cartridge 600, its ribs 602L perform the function of preventing the absorbers 604Y, 604M, and 604C from running over during the production process of cartridge. On the other hand, when the lid 601 is used for the black cartridge 500, the ribs 602L perform the function of effectively bringing the absorber 504 into pressure contact with the filter 505 in addition to the function of preventing the absorber 504 from running over during the production process of cartridge.

In this embodiment, the heights of all of the ribs 602S for holding down the absorbers 604Y, 604M, and 604C of the color cartridge 600 are made the same. However, as in the cases of the first and second embodiments, the ribs abutting against the absorber 604Y may be formed to be higher than the other ribs.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2003-434950 filed Dec. 26, 2003, which is hereby incorporated by reference herein.

What is claimed is:

1. An ink jet recording cartridge comprising:

an ink jet recording head configured to discharge ink;

at least one absorber holding the ink;

a case including:

at least one ink containing chamber sized and shaped to contain the absorber therein and having an opening, wherein the ease supports the ink jet recording head affixed thereto; and an ink introducing section communicating the ink containing chamber with the ink jet recording head;

a lid having a plurality of ribs, wherein the lid is adapted to attach to the case at the opening of the ink containing chamber such that the ribs abut the absorber to press the absorber against the ink introducing section, wherein the plurality of ribs includes first ribs having a different height than the other plurality of ribs, wherein the lid is adapted to attach to a plurality of kinds of ink jet recording cartridges that are different from each other in the number of the ink containing chambers, wherein the plurality of kinds of ink jet recording cartridges includes a black cartridge having the ink containing chamber containing a black ink, and a color cartridge having three ink containing chambers containing three color inks, and a T-shaped inner wall defining the three ink containing chambers of the color cartridge, and wherein the plurality of ribs includes first ribs provided at substantially a central portion of the three ink containing chambers, and second ribs provided at positions along a periphery of the ink containing chambers, and wherein the height of the second ribs being higher than that of the first ribs.

2. The ink jet recording cartridge according to claim 1, wherein the plurality of kinds of ink jet recording cartridges have substantially similar external shapes.

3. The ink jet recording cartridge according to claim 1, wherein the case includes a portion supporting the ink jet recording head affixed thereto, and projecting away from the lid.

4. The ink jet recording cartridge according to claim 3, wherein, as an external shape of the ink jet recording cartridge, particularly, the portion where the ink jet recording head is provided has an external shape projecting in the direction away from the lid, and wherein the ink jet recording cartridge having such an external shape can be configured so that the height of the first ribs of the lid, formed in positions opposite to the projection portion in the external shape is higher than that of the other ribs.

5. The ink jet recording cartridge according to claim 1, wherein the ink introducing section of the black cartridge has a larger bore than that of the ink introducing section of the color cartridge, and wherein the height of the first ribs disposed. opposite to the ink introducing section of the black cartridge is higher than that of the other ribs of the black cartridge.

6. The ink jet recording cartridge according to claim 5, wherein each of the absorbers contained in the respective ink containing chambers of the color cartridge has a rectangular parallelepiped shape.

* * * * *